US005411642A

United States Patent [19]

Traini et al.

[11] Patent Number: 5,411,642

[45] Date of Patent: May 2, 1995

[54] CHLOR-ALKALI ELECTROLYSIS PROCESS CARRIED OUT IN CELLS PROVIDED WITH POROUS DIAPHRAGMS

[75] Inventors: Carlo M. Traini, Milan, Italy; Antonio J. A. Maciel, apto.802, Meceiò-Esado de Alagoas, Brazil

[73] Assignees: De Nora Permelec do Brasil S.A.; Salgema Industrias Quimicas S.A.; Antonio Jose Acioli Maciel, all of Brazil

[21] Appl. No.: 246,174

[22] Filed: May 18, 1994

[30] Foreign Application Priority Data

May 28, 1993 [BR] Brazil ..... 9302093

[51] Int. Cl.[6] ..... C25B 1/20; C25B 1/26

[52] U.S. Cl. ..... 204/98; 204/128

[58] Field of Search ..... 204/98, 128, 129

[56] References Cited

U.S. PATENT DOCUMENTS

| | | | |
|---|---|---|---|
| 3,873,437 | 3/1975 | Pulver | 204/98 |
| 3,941,676 | 3/1976 | Macken | 204/280 |
| 4,026,785 | 5/1977 | Ford | 204/286 |
| 4,283,265 | 8/1981 | Byrd | 204/286 |
| 4,377,455 | 3/1983 | Kadija et al. | 204/98 |
| 4,448,664 | 5/1984 | Ikegami et al. | 204/288 |
| 4,789,443 | 12/1988 | deNora et al. | 204/128 |

*Primary Examiner*—Kathryn Gorgos

*Attorney, Agent, or Firm*—Bierman and Muserlian

[57] ABSTRACT

An improved chlor-alkali eletrolysis process carried out in cells comprising at least one couple of expandable anodes provided with mobile surfaces provided with an electrocatalytic coating, the couple being separated by a porous diaphragm, of the type made only of asbestos fibers, consisting in conducting an initial conditioning electrolysis step for a period longer than one hour, preferably between 5 and 10 days, with the anodes maintained in the restrained position by suitable retainers. After said conditioning step, the retainers are removed and the anodes set free to expand so that the respective mobile surfaces get in contact with the surfaces of the diaphragms. Electrolysis is carried out for prolonged times with low cell voltages and without noticeable damaging of the diaphragms.

12 Claims, 1 Drawing Sheet

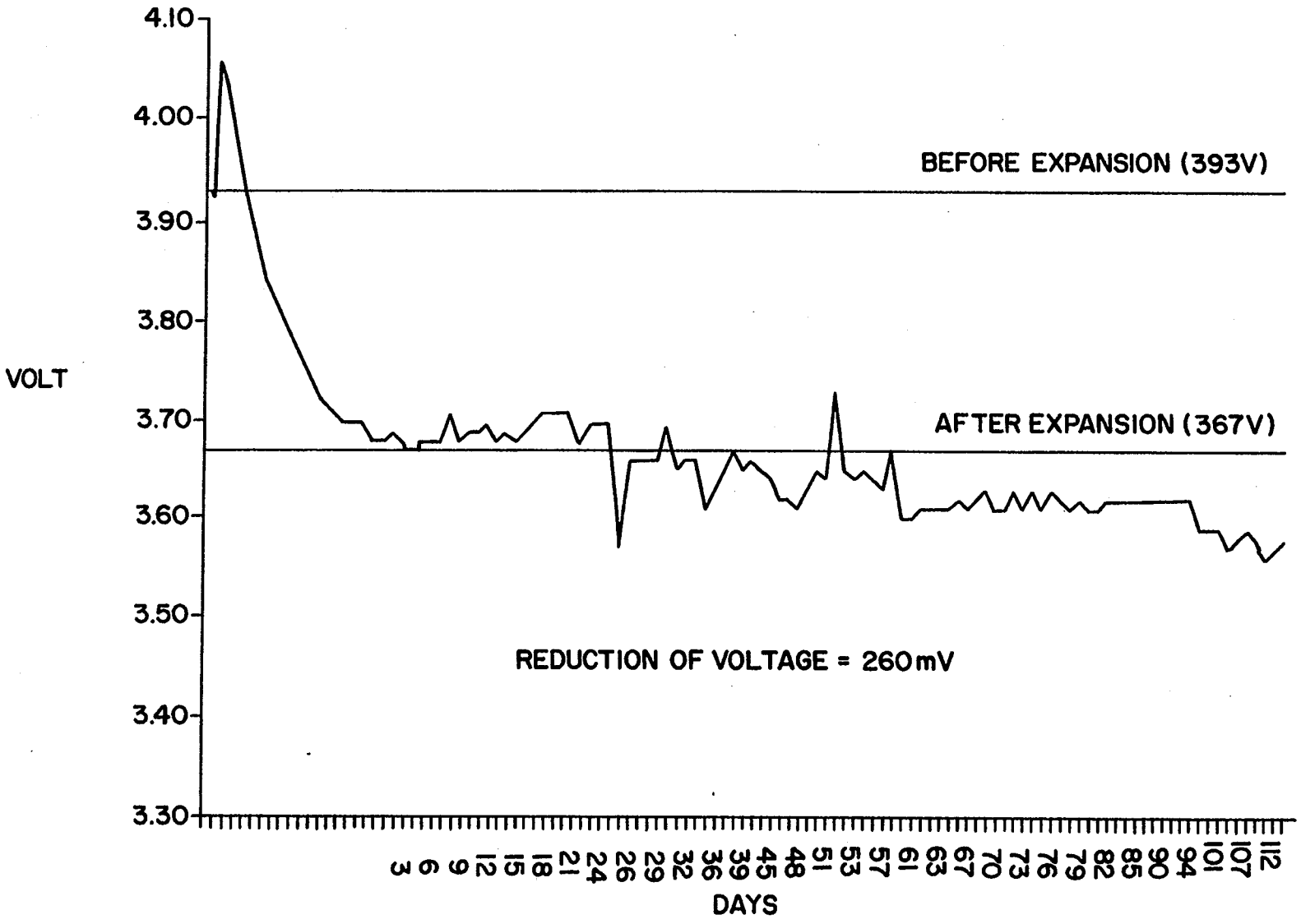
BEFORE EXPANSION (393V)
AFTER EXPANSION (367V)
REDUCTION OF VOLTAGE = 260mV
VOLT
4.10
4.00
3.90
3.80
3.70
3.60
3.50
3.40
3.30
DAYS
112
107
101
94
90
85
82
79
76
73
70
67
63
61
57
53
51
48
45
39
36
32
29
26
24
21
18
15
12
9
6
3

CHLOR-ALKALI ELECTROLYSIS PROCESS CARRIED OUT IN CELLS PROVIDED WITH POROUS DIAPHRAGMS

BACKGROUND OF THE INVENTION

Among electrolytic processes, chlor-alkali electrolysis has certainly the highest industrial interest. Briefly, by this method, the starting reactant, consisting of an aqueous solution of sodium chloride (hereinafter called brine), is separated into gaseous chlorine, an aqueous solution of sodium hydroxide and hydrogen gas by applying electric current, which, in a way, acts as a further reactant. Chlor-alkali electrolysis is carried out today by means of three alternative technologies, i.e. mercury cathode, porous diaphragm and ion-exchange membrane. This last one is the most modern technology and is characterized by low energy consumptions and lack of both environmental and health drawbacks.

Of the first two, the mercury cathode technology is probably bound to a rapid decline in consideration of the strict regulations existing in all the industrial countries in regard to the release of mercury in the environment. The improved cell design allows for meeting the severe tolerance limits imposed by the law, but the public opinion nowadays clings to an "a priori" rejection of any process which may lead to a possible release of heavy metals in the environment.

At present, the diaphragm technology relies on two alternative processes based on the use of diaphragms made only of asbestos fibers or comprising also an organic binder, respectively. The diaphragms made of asbestos fibers only are negatively affected by a poor mechanical stability. As far as it is known today, asbestos fibers may be removed by the erosion caused by the chlorine bubbles with the consequent deterioration of the diaphragm and the sharp and risky increase of the hydrogen content in chlorine. Therefore, in the prior art, efforts have always been pursued to ensure a sufficient distance between the diaphragm and the anode surface in an attempt to minimize the erosion effect. Consequently, cells provided with diaphragms made only of asbestos fibers cannot exploit to the best the advantages offered by the expandable anodes available on the market. As is well known, said anodes have the shape of a flat box wherein the major surfaces, independent from each other, are mobile being provided with expanding means; that is elastic supports capable of exerting a spring action. During assembly, when the anodes are inserted in the limited space between each couple of adjacent cathodes, they are maintained in the restrained position by means of suitable retainers. Once the anodes are positioned, the retainers are removed and the major surfaces of the anodes are pushed by the expanding means towards the opposite surfaces of the diaphragms deposited onto the cathodes. As a general rule, if the expanding means are correctly dimensioned, the anodic surfaces come in contact with the diaphragm surfaces, attaining a configuration known in the art as "zero-gap". In this configuration, the distance between anode and cathode is reduced to the minimum, and therefore, also the cell ohmic drop is minimized, which results in a remarkable energy saving for the electrolysis process. However, in the case of cells provided with diaphragms comprising asbestos fibers only, this advantage must be given up as the cell voltage tends to increase with time, and the diaphragm is often damaged by the intense erosion due to the gas bubbles evolved just on the diaphragm surface. Therefore, with diaphragms made of asbestos fibers only, so far expandable anodes could not be used and a fixed gap is maintained, usually in the range of 6–10 min. Obviously, in this way, the ohmic drop in the electrolyte is higher than in the zero-gap configuration, and therefore, the energy consumption is higher.

A prior art solution to the drawbacks of the diaphragm consisting only of asbestos fibers, comprises adding to the fibers a suitable corrosion-resistant polymeric binder, such as polychlorotrifluoroethylene or the like. These diaphragms, known as modified diaphragms, exhibit a remarkably higher mechanical stability and might certainly operate with a zero-gap configuration with their surfaces in contact with the anodic surfaces. However, the results in terms of cell voltage obtained with anodes in the zero-gap configuration and modified asbestos diaphragms are not as satisfactory as expected. In fact, the cell voltage, which should decease regularly as the gap between the anode and the diaphragm decreases, reaches its minimum at a distance in the range of 3.5–4 mm (see J. W. Winingsand D. M. Porter in Modem Chlor-Alkali Technology, 1980, pages 30–32). Presumably this effect is caused by the presence of the polymeric binder which tends to give a certain hydrophobicity to the diaphragm on whose surface, therefore, the chlorine gas bubbles tend to stick, the more when the bubbles are numerous; that is the more the surface of the diaphragm is dose to that of the anode. The bubbles sticking to the diaphragm represent a barrier to the passage of current, and this explains why, below a certain critical gap (3.5–4 mm as aforesaid), the cell voltage does not decrease anymore as the gap decreases, but on the contrary, it tends to increase (bubble effect).

OBJECTS OF THE INVENTION

It is an object of the present invention to provide for a method which overcomes the drawbacks affecting diaphragm cells of the prior art utilizing diaphragms made of asbestos fibers only; that is substantially hydrophilic, in a zero-gap configuration.

This and other advantages of the present invention will become apparent from the following detailed description.

DESCRIPTION OF THE INVENTION

The present invention concerns diaphragm electrolysis cells provided with cathodes, asbestos fibers diaphragms and expandable anodes comprising mobile surfaces, expanding means and retainers.

It has been surprisingly found that expandable anodes may be freely expanded until their mobile surfaces are in contact with the surfaces of the diaphragms made of asbestos fibers only, without any damage due to erosion caused by the chlorine gas bubbles. This result is obtained when the cells, provided with new diaphragms, are operated for a period longer than one hour, preferably 5–10 days, with the anodes in the restrained position, thus with a gap between the diaphragm and the mobile surfaces of the anode of about 10 mm. After this conditioning step, the cells are shut-down, opened according to the standard procedures, and the retainers are removed. In this way, the mobile surfaces of the anodes, under the unrestricted pressure of the expanding means, are free to contact the respective opposite surfaces of the diaphragms.

Further, it has been surprisingly found that diaphragms made only of asbestos fibers efficiently withstand the erosion action of chlorine gas bubbles without failures in the performances even after prolonged operation in a zero-gap configuration. This result is confirmed by the low content of hydrogen in chlorine. It has been also found that in these conditions the cell voltage is constant with time and particularly low, about 0.2 volts lower than the average voltage in cells operated according to the conventional method; that is with a gap between the anode and the diaphragm. This improved cell voltage is certainly to be ascribed to the reduced distance between the anode and the cathode, as discussed above, and to the scarce adhesion of the chlorine gas bubbles to the surface of the diaphragm made only of asbestos fibers and, therefore, substantially hydrophilic.

In regards to the surprising effect of the present invention, that is the unexpected mechanical stability of the diaphragm made only of asbestos fibers in a zero-gap configuration (maximum erosive effect of the chlorine gas bubbles), without binding the validity of the present invention to any theory, it is assumed that initial operation with a large gap (10 mm indicatively, anodes in the restrained position) permits evolution of the diaphragm structure which involves expansion (swelling) of the fibers, with an increase of their intersection and/or the deposition of cementing components, for example colloidal hydroxides of impurities contained in the brine, such as iron, manganese, other heavy metals, magnesium. Remarks on the evolution of diaphragms containing asbestos fibers are found in the technical literature, where said phenomena are defined as gelation or maturing. No hint is, however, found in the technical literature on the advantages which could be obtained by bringing the anodes to a zero-gap configuration upon modifying the diaphragm by means of a suitable conditioning period of electrolysis in a (definite) large-gap configuration. In any case, as a result of this evolution of the diaphragm structure, the fibers are mechanically stabilized, and presumably, this mechanical stabilization is further enhanced by the compression exerted by the mobile surfaces of the anodes.

It should be taken into account that the advantages offered by the present invention may be obtained also without opening the cell after the large-gap operation period in order to prevent chlorine gas losses in the environment, to save the maintenance costs and not to interrupt the chlorine production. This further object of the present invention is attained by providing the anodes with suitable retainers which undergo dissolution after a period longer than one hour, typically 5–10 days. For this purpose, the retainers must be made with material which slowly dissolve in chlorine-containing brine, such as suitable plastic materials or more properly metal alloys, such as stainless steels, preferably high-alloy steels. In order to better illustrate the present invention, some examples are reported here under. However, the present invention is not to be intended as limited to these specific embodiments.

EXAMPLE 1

In a chlor-alkali electrolysis plant made of diaphragm cells of the Hooker H2A type, a cell has been shut-down and substituted with a similar cell provided with a new diaphragm made of asbestos fibers only and with-expandable anodes maintained in the restrained position by means of suitable retainers. The anodes and the diaphragm were maintained about 8 mm spaced apart. The cell has been started up and operated for 5 days at the average conditions of the other cells of the plant, in particular:

| | |
|---|---|
| brine flow | 1 $m^3$/hour |
| electric load | 96 kA |
| current density | 2.6 kA/$m^2$ |
| catholyte composition: | NAOH 150 g/l |
| | NaCl 175 g/l |
| temperature | 99° C. |
| oxygen in chlorine | 1.8% |
| hydrogen in chlorine | 0.2% |

After the five day conditioning step, the cell has been shut-down and opened following the standard procedure, the retainers have been removed and the anodes set free to expand until in contact with the opposite surfaces of the diaphragm.

The cell has been re-started and brought to the normal conditions of operation as above stated.

FIG. 1 shows the behavior of the voltage after expansion of the anodes, compared with the average voltage of the same cell before expansion; this latter voltage being a sufficiently representative value of the average value of the remaining cells of the plant, with similarly aged diaphragms. As it may be observed, an average decrease of the voltage of about 0.2 volts is obtained.

For comparison purposes, a reference cell has been provided with a new diaphragm made of asbestos fibers only and operated with expanded anodes; that is without retainers from the beginning. After a few days of operation, the cell has been shut down due to a high content of hydrogen in chlorine. A subsequent inspection evidenced that the diaphragm was badly damaged on the upper part, where, presumably, the turbulence induced by the chlorine gas bubbles is higher. The negative behavior of the reference cell confirms the validity and the importance of the results which may be obtained with the present invention.

EXAMPLE 2

A cell has been prepared as described in Example 1 and operated for an 8 day electrolysis conditioning period with the anodes in the restrained position. Likewise in Example 1, the cell has been shut-down in a restrained position. Likewise in Example 1, the cell has been shut-down, opened and the retainers have been removed after inserting the spacers consisting of polytetrafluoroethylene spaghettis having a diameter of 1.5 mm and the same length as the anode. Said spacers have been vertically positioned with a spacing of 30 cm from each other. In this way, the pressure exerted by the expanding means onto the surfaces of the anodes kept said anodes surfaces at an average distance of 1.5 mm from the surfaces of the diaphragms. The cell was started up again and brought back to the average conditions of Example 1 . Once stabilized, the voltage resulted about 0.08 volts higher than that of Example 1. Also, in this case, the asbestos fibers diaphragm resulted perfectly stable, due to the previous electrolysis conditioning period in the large-gap configuration.

EXAMPLE 3

Another cell has been prepared as described in Example 1 with the only difference that the new diaphragm made only of asbestos fibers was deposited onto the cathode, upon applying onto the cathode where the cathodes have a mesh made of polyvinylchloride wire having a diameter of 0.5 mm and forming a square pattern with apertures of 3×3 mm applied thereto. The cell voltage was practically similar to that of Example 1, and the diaphragm was mechanically stable as demonstrated by the constantly low content of hydrogen in chlorine. The function of the polyvinylchloride mesh inserted between the cathode and the diaphragm was to increase the reliability of the cell, avoiding short-circuits between the anode and the cathode with the anode in the expanded position in the case of deterioration of the diaphragm. This additional reliability was obtained, as shown above, at no-expense of the cell voltage.

We claim:

1. Improved chlor-alkali electrolysis process carried out in cells comprising at least one couple of cathodes and expandable anodes, provided with mobile surfaces, separated from each other by a porous diaphragm deposited onto said cathodes and made only of asbestos fibers, characterized in that a conditioning step of electrolysis is carried out while maintaining said anodes in the restrained position and thereafter electrolysis is carried out releasing the anodes to the expanded position.

2. The process of claim 1 wherein said conditioning step is carried out for a period longer than one hour.

3. The process of claim 1 where said conditioning step is carried out for a period comprised between five and ten days.

4. The process of claim 1 wherein said anodes in the expanded position are in contact with said porous diaphragms.

5. The process of claim 1 wherein said anodes in the restrained position are provided with retainers made of corrosion resistant material.

6. The process of claim 5 wherein said retainers are manually removed after the conditioning step.

7. The process of claim 1 wherein said anodes in the restrained position are provided with retainers made of soluble material.

8. The process of claim 7 wherein said retainers are dissolved after the conditioning step.

9. The process of claim 1 wherein said anodes in the expanded position are further provided with spacers made of electrically insulating material resistant to corrosion.

10. The process of claim 9 wherein said spacers consist of spaghetti made of polytetrafluoroethylene arranged in a parallel way and vertically along said mobile surfaces of the anodes.

11. The process of claim 1 wherein porous spacers made of insulating material resistant to corrosion are positioned between said cathodes and said diaphragms made only of asbestos fibers deposited onto said cathodes.

12. The process of claim 11 wherein said spacers are meshes of wire made of polyvinylchloride, said wire having a diameter of 0.5 mm and forming a square pattern with apertures of 3×3 mm.

* * * * *